US006658689B2

(12) United States Patent
Vosbikian

(10) Patent No.: US 6,658,689 B2
(45) Date of Patent: Dec. 9, 2003

(54) DUAL THREAD BROOM HEAD CONNECTOR

(75) Inventor: Peter S. Vosbikian, Moorestown, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 352 days.

(21) Appl. No.: 09/877,702

(22) Filed: Jun. 7, 2001

(65) Prior Publication Data

US 2002/0184725 A1 Dec. 12, 2002

(51) Int. Cl.[7] ..... A46B 5/00
(52) U.S. Cl. ..... 15/176.2; 15/145
(58) Field of Search ..... 15/145, 171, 176.1, 15/176.2, 176.6; 16/422; 411/366.1, 424, 426, 412

(56) References Cited

U.S. PATENT DOCUMENTS 1,849,069 A * 3/1932 Bridges ..... 403/334
5,161,278 A * 11/1992 Tomm ..... 15/159.1
6,053,653 A * 4/2000 Tanaka et al. ..... 403/282
6,125,526 A * 10/2000 Wierzchon ..... 29/525.02

* cited by examiner

*Primary Examiner*—Terrence R. Till
(74) *Attorney, Agent, or Firm*—Stuart M. Goldstein

(57) ABSTRACT

A connector is disclosed for use between a broom handle and its broom head and has other applications in which it is deemed desirable to obtain a quick and secure connection between threaded components. The male component of the connector consists of two adjacent sections of male threads, the first section having a smaller width or diameter than the second section. The first section forms the end of the male component. In the case of a broom handle, this is the end of the handle. The female component of the connector consists of an opening or cavity with female, receiving threads. In the case of a broom head, this is the opening within the head. The female component also has two opening sections of varying widths or diameters. The sections of the female component are each configured to threadably engage the respective threaded sections of the male component. This dual threaded connection system requires as few as one large or just two or three smaller threads on each section and so ensures for a quick and secure attachment between the male component/broom handle and the female component/broom head.

11 Claims, 2 Drawing Sheets

DUAL THREAD BROOM HEAD CONNECTOR

BACKGROUND OF THE INVENTION

The connection between the handle of a broom and the broom head itself is routinely accomplished by threaded engagement, for example as seen in U.S. Pat. No. 4,384,383. Male threads on the end of the handle are screwed into an opening in the broom head, the opening having female threading to receive the male threads. Such a connection, however, has several disadvantages.

First, in order to obtain a secure connection, multiple turns of threading, as many as four, five, six, or more, are needed. This entails turning the handle multiple times within the broom head opening, in order to attach the handle to the head. While this task is relatively simple when attaching the components of a single broom, it becomes more difficult and time consuming when multiple brooms must be assembled. Such a circumstance often occurs in the marketplace, where separate broom components are shipped by the manufacturer to the retailer who must then assemble dozens of handles and broom heads.

In addition, the single thread system which is employed between a broom head and handle also is subject to coming loose while the broom is in use. This requires stoppage of the sweeping operation and a tightening of the handle/broom head connection.

SUMMARY OF THE INVENTION

It is an object of the present invention to overcome the limitations and disadvantages of prior threaded connections.

It is an object of the present invention to provide a threaded connector with a dual thread system which ensures for quick and easy attachment between threaded components.

It is another object of the invention to provide a threaded connector with a dual thread system for ensuring for a secure attachment between threaded components.

It is still another object of the present invention to provide a threaded connector with a dual thread system for quick and easy attachment between a broom head and broom handle.

It is a further object of the invention to provide a threaded connector with a dual threaded system for ensuring an attachment which remains secure between a broom head and broom handle of a broom during use of the broom.

It is another object of the invention to provide a threaded connector with a dual thread system which uses less threads to establish a quicker and more secure connection than prior connections between threaded components.

The present invention is contemplated primarily for use as a connector between a broom handle and its broom head. However, the connector has other applications in which it is deemed desirable to obtain a quick and secure connection between threaded components. The male component of the connector consists of two adjacent sections of male threads, the first section having a smaller width or diameter than the second section. The first section forms the end of the male component. In the case of a broom handle, this is the end of the handle. The female component of the connector consists of an opening or cavity with female, receiving threads. In the case of a broom head, this is the opening within the head. The female component also has two opening sections of varying widths or diameters. The sections of the female component are each configured to threadably engage the respective threaded sections of the male component. This dual threaded connection system requires as few as one large or just two or three smaller threads on each section and so ensures for a quick and secure attachment between the male component/broom handle and the female component/broom head.

The novel features which are considered as characteristic of the invention are set forth in particular in the appended claims. The invention, itself, however, both as to its design, construction, and use, together with the additional features and advantages thereof, are best understood upon review of the following detailed description with reference to the accompanying drawings.

DETAILED DESCRIPTION OF THE INVENTION

Figure 1:
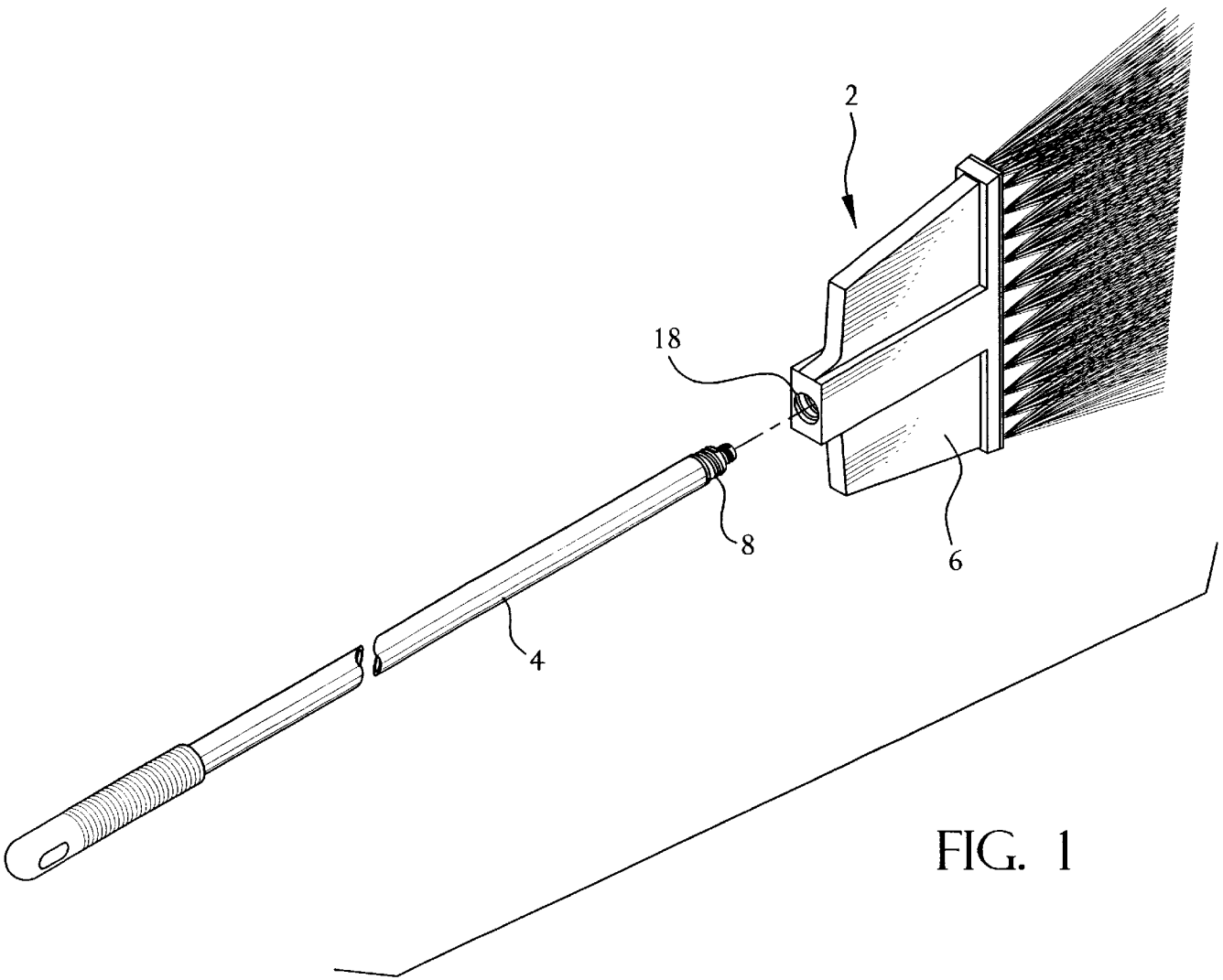
FIG. 1 is an isometric view of the connector of the present invention in use with a broom head and handle of a broom.
Figure 2:
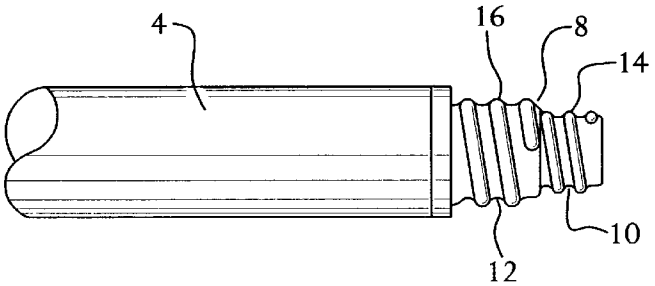
FIG. 2 is a side view of the end of the broom handle or male component of the connector of the present invention.
Figure 3:
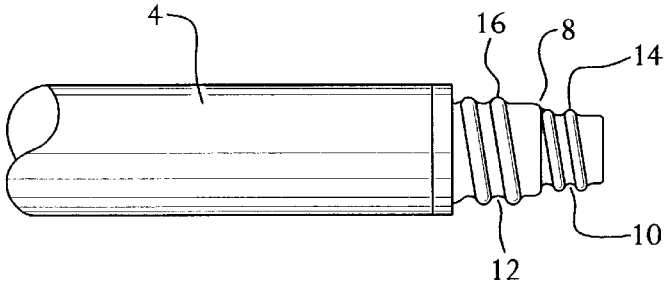
FIG. 3 is a side view of an alternate embodiment of the broom handle or male component of the connector of the present invention.
Figure 4:
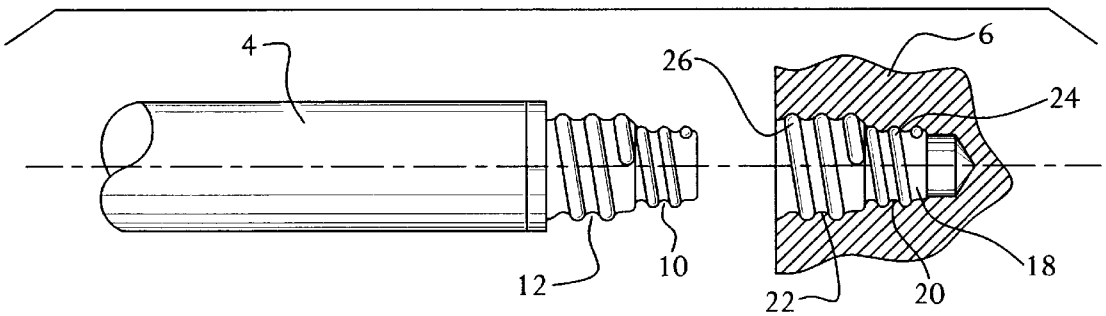
FIG. 4 is a side view of the broom handle or male component shown in FIG. 2 and a partial cross-section of the broom head or female component of the connector of the present invention.

Broom 2 consists of handle 4 which is to be threadably connected to broom head 6. Threaded male component 8 is located at the end of handle 4. Component 8 comprises sections 10 and 12, each section having male threads 14 and 16, respectively. Section 10 has a width, or in the case of cylindrically shaped handle 4, diameter, which is less than the width or diameter of section 12. While male component 8 is shown as being cylindrical with a diameter, is contemplated that other shaped components may employ this connector system and that the invention is not to be limited to cylindrical components. It is anticipated that only two or three male threads 14 and 16 or as few as a single larger thread, will be required on each section 10 and 12. FIG. 2 shows the use of two and a half threads on each section. FIG. 3 shows the use of two threads on each section.

Broom head 6 has opening or cavity 18, configured to threadably receive male component 8 of handle 4. Opening 18 comprises sections 20 and 22 with female threading 24 and 26, respectively. Female threading 24 of section 20 is configured to threadably receive and engage male threads 14 of section 10 of male component 8 and female threading 26 of section 22 is configured to threadably receive and engage male threads 16 of section 12 of male component 8.

In use, component 8 of handle 4 is inserted into opening 18 of broom head 6. In the embodiment shown, two or three turns of handle 4 will result in the simultaneously threaded and secure engagement of section 10 within section 20 and section 12 within section 22.

While the embodiment presented herein contemplates the use of a dual thread connector system for the attachment of a cylindrical broom head to a broom head with a circular opening, the subject invention can be configured in other than circular shape. That is, the male/female components can be of any shape which is conducive to maintaining a threaded connection. As long as the respective sections of the components are of varying diameters or widths, the connector will function satisfactorily.

In addition, while the embodiment of the subject threaded connector is disclosed as having two sections at the end of the male component and two corresponding sections in the opening of the female component, more than two sections could be used. It has been found however, that the connector works well with two distinctly sized sections for each component.

Finally, while the embodiment presented herein discloses the subject connector in use with a broom head and handle, the connector can be used for, but is not limited to, handle connections for brushes, mops, shovels, or other manual tools. The connector has general application where it is deemed desirable to obtain a quick and secure connection between threaded components.

Certain novel features and components of this invention are disclosed in detail in order to make the invention clear in at least one form thereafter. However, it is to be clearly understood that the invention as disclosed is not necessarily limited to the exact form and details as disclosed since it is apparent that various modifications and changes may be made without departing from the spirit of the invention.

I claim:

1. A threaded connector system comprising:

a male element comprising a handle, said element having screw attachment means for quick and secure attachment to a female element, said screw attachment means comprising a first threaded section and a second threaded section, said first threaded section forming the end of the screw attachment means and having a width which is smaller than the width of the second threaded section; and a female element comprising a broom head, said female element having internally formed screw receiving means for quick and secure attachment with the male element, said screw receiving means comprising a first screw receiving section and a second screw receiving section, wherein said first screw receiving section is configured to be threadably connected to the first threaded section and the second screw receiving section is configured to be threadably connected to the second threaded section.

2. A threaded connector system comprising:

a male element with screw attachment means for quick and secure attachment to a female element, said screw attachment means comprising a first threaded section with no more than three threads and a second threaded section with no more than three threads, said first threaded section forming the end of the screw attachment means and having a width which is smaller than the width of the second threaded section; and a female element with internally formed screw receiving means for quick and secure attachment with the male element, said screw receiving means comprising a first screw receiving section and a second screw receiving section, wherein said first screw receiving section is configured to be threadably connected to the first threaded section and the second screw receiving section is configured to be threadably connected to the second threaded section.

3. A threaded connector system comprising:

a male element with screw attachment means for quick and secure attachment to a female element, said screw attachment means comprising a first threaded section with no more than two threads and a second threaded section with no more than two threads, said first threaded section forming the end of the screw attachment means and having a width which is smaller than the width of the second threaded section; and a female element with internally formed screw receiving means for quick and secure attachment with the male element, said screw receiving means comprising a first screw receiving section and a second screw receiving section, wherein said first screw receiving section is configured to be threadably connected to the first threaded section and the second screw receiving section is configured to be threadably connected to the second threaded section.

4. A broom comprising:

a handle with screw attachment means or quick and secure attachment to a broom head, said screw attachment means comprising a first threaded section and a second threaded section, said first threaded section forming the end of the screw attachment means and having a width which is smaller than the width of the second threaded section; and a broom head with internally formed screw means for quick and secure attachment with the handle, said screw receiving means comprising a first screw receiving section and a second screw receiving section, wherein said first screw receiving section is configured to be threadably connected to the first threaded section and the second screw receiving section is configured to be threadably connected to the second threaded section.

5. A broom comprising:

a handle with screw attachment means for quick and secure attachment to a broom head, said screw attachment means comprising a first threaded section with no more than three threads and a second threaded section with no more than three threads, said first threaded section forming the end of the screw attachment means and having a width which is smaller than the width of the second threaded section; and a broom head with internally formed screw means for quick and secure attachment with the handle, said screw receiving means comprising a first screw receiving section and a second screw receiving section, wherein said first screw receiving section is configured to be threadably connected to the first threaded section and the second crew receiving section is configured to be threadably connected to the second threaded section.

6. A broom comprising:

a handle with screw attachment means or quick and secure attachment to a broom head, said screw attachment means comprising a first threaded section with no more than two threads and a second threaded section with no more than two threads, said first threaded section forming the end of the screw attachment means and having a width which is smaller than the width of the second threaded section; and a broom head with internally formed screw means for quick and secure attachment with the handle, said screw receiving means comprising a first screw receiving section and a second screw receiving section, wherein said first screw receiving section is configured to be threadably connected to the first threaded section and the second screw receiving section is configured to be threadably connected to the second threaded section.

7. A threaded connector system comprising:

a substantially cylindrical male element with screw attachment means for quick and secure attachment to a female element, said screw attachment means comprising a first threaded section with no more than two threads and a second threaded section with no more than two threads, said first threaded section forming the end of the screw attachment means and having a diameter which is smaller than the diameter of the second threaded section; and a female element with internally formed screw receiving means for quick and secure attachment with the male element, said screw receiving means comprising a first screw receiving section and a second screw receiving section, wherein said first screw receiving section is configured to be threadably connected to the first threaded section and the second screw receiving section is configured to be threadably connected to the second threaded section.

8. A broom comprising:

a substantially cylindrical handle with screw attachment means for quick and secure attachment to a broom head, said screw attachment means comprising a first threaded section and a second threaded section, said first threaded section forming the end of the screw attachment means and having a diameter which is smaller than the width of the second threaded section; and a broom head with internally formed screw means for quick and secure attachment with the handle, said screw receiving means comprising a first screw receiving section and a second screw receiving section, wherein said first screw receiving section is configured to be threadably connected to the first threaded section and the second screw receiving section is configured to be threadably connected to the second threaded section.

9. A broom comprising:

a handle having a connector end with two sections, the first section being of a given diameter and comprising an outer surface with male threading thereon, the second section having a diameter greater than the diameter of the first section, the second section comprising an outer surface and male threading on the outer surface of the second section; and a broom head comprising a cavity, said cavity comprising first and second cavity sections each comprising female threading, the first cavity section having a diameter which is substantially the same as the diameter of the first section of the connector end for threadably mating with the first section of the connector end, and the second cavity section having a diameter which is substantially the same as the diameter of the second section of the connector end for threadably mating with the second section of the connector end.

10. The broom as in claim 9 wherein the male threading on the first section of the connector end comprises no more than two male threads, the male threading on the second section of the connector comprising no more than two male threads, and the female threading in the receiving threads.

11. The broom as in claim 9 wherein the male threading on the first section of the connector end comprises no more than three male threads, the male threading on the second section of the connector comprising no more than three male threads, and the female threading in the first cavity section and in the second cavity section each comprising no more than three female receiving threads.

* * * * *